US005369936A

United States Patent [19]

Callahan et al.

[11] Patent Number: 5,369,936

[45] Date of Patent: Dec. 6, 1994

[54] APPARATUS AND METHOD FOR SECURING A DETACHABLE PROMOTIONAL BANNER OR COUPON TO A FLEXIBLE PACKAGE

[75] Inventors: Stephen Callahan, Lewisville; Stephen Holten, Carrollton; Jerry Reaves, Midlothian, all of Tex.

[73] Assignee: Recot, Inc., Plano, Tex.

[21] Appl. No.: 848,173

[22] Filed: Mar. 10, 1992

[51] Int. Cl.[5] ..... B65B 61/20

[52] U.S. Cl. ..... 53/415; 53/135.2; 53/135.3

[58] Field of Search ..... 53/135.1, 135.2, 135.3, 53/415, 131.5; 156/324; 493/381

[56] References Cited

U.S. PATENT DOCUMENTS

| | | | |
|---|---|---|---|
| 2,082,114 | 6/1937 | Littlefield | 53/131.5 X |
| 2,160,367 | 5/1939 | Maxfield . | |
| 2,259,866 | 10/1941 | Stokes . | |
| 2,685,537 | 8/1954 | Dunmire . | |
| 2,815,620 | 12/1957 | Prodigo . | |
| 3,000,155 | 9/1961 | Gausman . | |
| 3,152,010 | 10/1964 | Case . | |
| 3,289,386 | 12/1966 | Farmer . | |
| 3,557,516 | 1/1971 | Brandt | 53/135.3 X |
| 4,288,965 | 9/1981 | James . | |
| 4,537,586 | 8/1985 | Gale et al. | 493/220 |
| 4,651,499 | 3/1987 | Krichiver | 53/135.3 |
| 4,726,171 | 2/1988 | Kreager et al. . | |
| 4,832,776 | 5/1989 | Pace | 53/135.3 X |
| 4,906,319 | 3/1990 | Fiorani | 53/134.1 X |

*Primary Examiner*—John Sipos
*Assistant Examiner*—Daniel Moon
*Attorney, Agent, or Firm*—Rothwell, Figg, Ernst & Kurz

[57] ABSTRACT

Apparatus and methods for producing a flexible package having a banner or coupon adhered thereto attach a continuous banner stock to a continuous web of packaging film. The united web is processed through a form, fill and seal apparatus wherein the web is fed to a vertical form-fill tube, formed into a tubular package preform, and sealed as the preform exits the tube.

8 Claims, 5 Drawing Sheets

APPARATUS AND METHOD FOR SECURING A DETACHABLE PROMOTIONAL BANNER OR COUPON TO A FLEXIBLE PACKAGE

BACKGROUND OF THE INVENTION

1. Field of the Invention

This invention generally relates to apparatus and methods for packaging articles. The invention specifically relates to apparatus and methods for attaching pre-printed promotional banners, coupons and similar items to the exterior of a flexible snack food package.

2. Description of the Background Art

It has long been recognized as desirable to attach promotional banners, advertising coupons, "premiums" or similar items to bags or other packages of commercial products. One of the simplest methods employed is to print a coupon directly onto the bag or package as part of its labelling. The inconvenience of tearing or cutting the package to separate the coupon is apparent, and consumers do not favor this approach. Of course, cutting or tearing the package destroys its integrity, so that the coupon cannot readily be removed until the package is empty.

Another method for providing a coupon on the exterior of a package is to attach the coupon with an adhesive to the package. Typically, coupons are printed upon pressure-sensitive label stock, and are adhered to the web of packaging material one label at a time as the packaging material is being processed to form a package. Preparing and affixing such coupons has shown to be relatively expensive, however.

One potentially inexpensive method for providing a coupon on a flexible package employs a continuous banner stock. The text of coupons or other promotional materials are printed upon the banner stock, which is fed in tandem with the packaging stock to a form-fill-seal apparatus. The banner stock is affixed to the packaging material at the same time the top and bottom seals are formed. In general the banner stock is relatively inexpensive, and appropriate vertical form-fill-seal equipment requires only minor modification to accommodate it.

A specific example of this method for providing a coupon on the exterior of a package is illustrated in U.S. Pat. No. 2,815,620 to Prodigo. Prodigo discloses a conventional vertical form, fill and seal apparatus for packaging products wherein a web of packaging material is fed to a vertical tube, formed into a tubular package preform and sealed. Prodigo advances his tubular preform with clamping jaws which pull the preform down along the vertical tube in increments equal to the length of the finished package. The clamping jaws also form the transverse seal of the package and sever the sealed package from the preform.

The Prodigo patent illustrates a method for providing a detachable coupon to the exterior of the package. Banner stock is fed into proximity of the package preform well after the preform has been formed around a former tube and longitudinally sealed, however. This feature is seen in FIG. 3 of the Prodigo patent. The banner web and packaging film are not united until the clamping jaws adhere the banner web to the package preform at the location of the transverse package seals.

It has been found, however, that the tension of the banner stock can interfere with the desired smooth transport of the packaging material in apparatus employing means other than clamping jaws to advance the preform. Pull belts and pulleys, such as those disclosed in U.S. Pat. No. 4,288,965 to James, are in common use in vertical form-fill-seal apparatus. Generally, the pull belts engage the side edges of the preform and then advance the preform down along the form-fill tube in package-length increments. When banner stock is fed into joinable proximity to a preform, i.e., as Prodigo has done, the continuous banner unacceptably interferes with the advance sequence of the preform. As a result, a large amount of the banner stock can be lost as waste. Tracking and registration problems can also be caused by improper tension on the banner rollstock.

SUMMARY OF THE INVENTION

The primary objectives of this invention are to enjoy the cost benefits of attaching coupons from a continuous banner stock to the exterior of flexible packages in a form, fill and seal packaging apparatus and method, but at the same time to avoid the waste and inefficiencies which can occur when using such apparatus and methods. These objectives are achieved by the present invention, namely, apparatus and methods for forming, filling and sealing packages and for attaching banners to the packages. In one aspect the present invention provides an apparatus comprising means for feeding pre-printed banner stock within joinable proximity of a continuous web of flexible packaging material traveling along a path, means for adhering the banner stock to the continuous web at pre-selected intervals to thereby produce a "united web," with the feeding means and the adhering means being disposed along the web travel path prior to (or "upstream" of) means for forming the united web into a package. Typically, although not exclusively, the means for forming the web into a package is a vertical form, fill and seal apparatus.

In another aspect, the present invention provides a method for making a flexible package (such as a snack food package) with a pre-printed promotional banner secured to the exterior of the package, comprising feeding a continuous web of flexible packaging stock and a continuous web of pre-printed banner stock into joinable proximity of each other, joining together the two webs along pre-selected intervals thereof to produce a united web, and then producing a package from the united webs. Again, the united webs are formed into a package typically, but not exclusively, by a vertical form-fill-seal apparatus.

Specific embodiments of the invention will be evident from the detailed description below, which is to be read in conjunction with the drawing figures in which:

DESCRIPTION OF THE PREFERRED EMBODIMENTS

Figure 1:
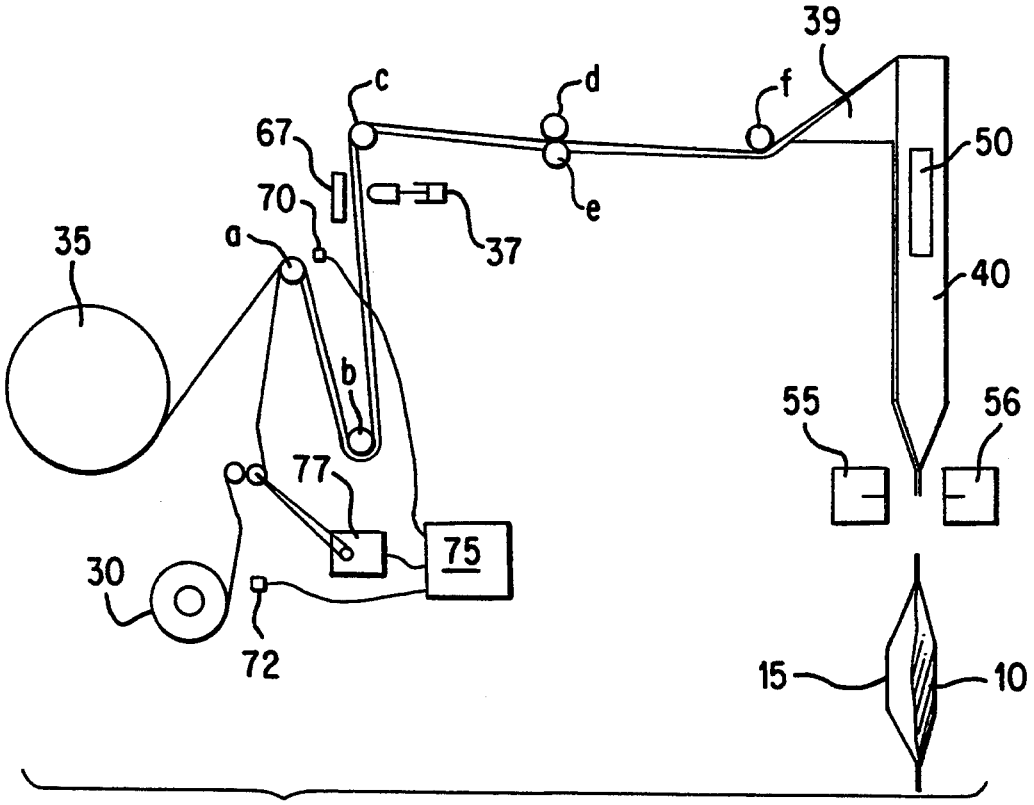
FIG. 1 is an elevational view and schematic illustration of one embodiment of the invention.

The invention can be described with reference to the preferred embodiments illustrated in the drawings. As presently is preferred, our invention is practiced in connection with what can be generally classified as a form-fill-seal apparatus. Such apparatus are well known to those familiar with the packaging field, especially the packaging of snack food items such as potato chips, corn chips, popcorn and the like. Typically a vertical form-fill-seal apparatus processes a continuous web of package-forming material by forming the web into a package preform around a vertical former tube, sealing the bottom of the preform, filling the preform with product by passing the product through the former tube and then sealing the top of the preform to create a finished package. U.S. Pat. No. 4,726,171 to Kreager, et al. illustrates such an apparatus. Form-fill-seal apparatus are widely commercially available.

A typical form-fill-seal packager is illustrated schematically in FIG. 1. A continuous web 35 of flexible packaging material is fed along a path through the apparatus, guided by a series of rollers illustrated as (a)–(f). A series of rollers, dancers and other web guides serves to guide the web along the desired path and to regulate the tension of the web. The web is fed to an apparatus for forming the web into a tubular package preform which is then filled with product and then sealed to produce discrete, filled packages. The apparatus for forming the preform is schematically illustrated as 39 and 40 in FIG. 1, where 39 represents a forming collar and 40 represents a vertical forming and filling tube. The forming collar 39 and tube 40 act in concert to wrap the web of packaging material around tube 40 and thereby create a hollow, tubular package preform. The longitudinal or 'back' seal of the preform is created by a sealing device (not illustrated here) to provide a typical fin-seal or lap-seal configuration.

The preform is advanced down the tube in increments equal to the length of the finished package by an advancement means 50, which in a preferred embodiment consists of a pull belt and pulley arrangement. The pull belt grasps the package preform along its sides, pulling it downward along the form-fill tube 40. The packaging film typically contains printing, and thus it is critical to advance the film in a registered manner so that the printing appears properly oriented on the finished package. Suitable devices for maintaining the film in proper registration are well known and typically use a photo-detector (to detect gaps or distinctive markings between the printed areas) which provides a signal to an automated control system.

The lower portion of the preform is transversely sealed by sealing means 55 and 56 which typically consist of heat seal jaws for welding together and crimping the flexible package material. After the lower seal is formed, the preform is filled with product, advanced by a bag-length increment along the former tube and then sealed at its upper portion. As the upper seal is formed, the fully sealed package is severed from the continuous web and the tubular preform immediately above, thereby resulting in a discrete filled package 10.

As indicated in FIG. 1, this type of packaging apparatus has been modified in accordance with the present invention to provide promotional banners attached to the finished package. A continuous, pre-printed banner stock 30 is fed into joinable proximity with an outer surface of the continuous web 35. In this particular version of the invention, the web and banner are brought within joinable proximity of each other at roller (a). The exact location and arrangement of the rollers, dancers and other web guides and tensioners can be altered, however, and those skilled in this field will envision other suitable, operable arrangements which provide even tension to the webs.

Because both the banner stock and packaging film typically are pre-printed, it may be desirable to incorporate into the apparatus a suitable registration mechanism to maintain the two films in a desired orientation or "registration." Properly registering the banner stock with respect to the packaging film insures that the banner contains the entire printed text of a promotional message or coupon, for example.

Suitable systems for maintaining the banner stock and packaging film in proper registration as they pass through the web paths are well known to those who are knowledgeable in the field of packaging systems. FIG. 1 illustrates in schematic form one typical, suitable system, comprised of optical sensors 70 and 72 which sense pre-selected indicia (or merely gaps in the printed matter) found between the printed areas which make up the consecutive banners and packages on rolls of stock. In response to the signal from the sensor, controller 75 regulates drive motor 77 to control the play out of banner stock roll to maintain the two films in the desired registration. Those skilled in this field will readily recognize the many variations possible in such a registration control system.

The packaging film and banner are adhered together at the pre-selected interval by adhering means illustrated by 37 and 67, which are positioned along the path of the web prior to the forming collar means 39 and tube 40. Adhering means 37 and 67 consist of a heat seal unit in this preferred embodiment. The heat seal unit is activated by the automated system controller to adhere (heat tack) the banner to the web at least once per incremental advance of the web as it is processed through the apparatus. In this manner, the banner will be attached to the exterior of the completed package by at least one bond. The continuous banner and web, now joined at the pre-selected intervals, advantageously behave as a unitary structure throughout the remaining aspects of the form-fill-seal operation. This feature of the invention, which is not found in the prior art of which we are aware, is an important advantage; handling of the banner is much simpler and efficient once it is tacked to the web of flexible packaging material. The unitary web-banner is then further advanced through the preform forming collar means 39, around and down tube 40 toward sealing means 55 and 56.

Figure 2:
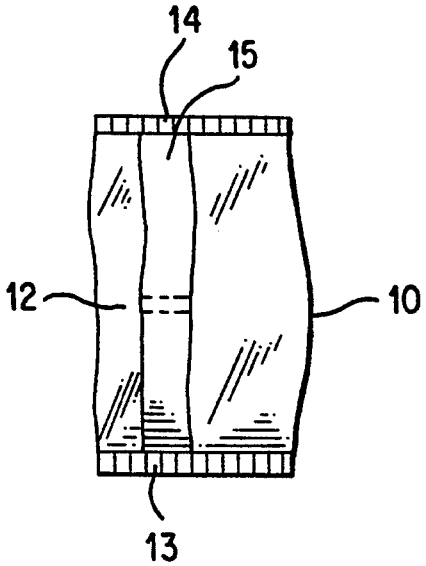
FIG. 2 is an elevational view of a package and banner strip attached thereto as prepared by one embodiment of the invention.

The banner strip additionally will be adhered to the package preform when the lower and upper package seals are formed. Thus, as illustrated in FIG. 2, once the package is severed from the continuous web, banner 15 is adhered to an outer surface intermediate to the package's upper and lower seal (at 12), as well as at 13 and 14 adjacent to the package's lower and upper seals.

Heat-sealing the promotional banner to the package provides secure attachment, yet allows the consumer to remove it intact from the package without damaging the integrity or contents of the package. Sealing the banner to the web of packaging material upstream of the form-fill-seal apparatus allows the banner—web pair to be transported through the form-fill seal apparatus as a unitary structure. This greatly simplifies web handling and dramatically reduces material waste.

The use of heat sealing equipment is contemplated when the flexible packaging film and the banner stock are thermoplastic materials. Thermoplastic films are in common use in the snack food packaging field. Those of ordinary skill in the field will be able to adapt the invention for use with other packaging materials, for example by substituting an adhesive applicator or an ultrasonic welding unit for the heat seal unit. The banner stock typically is somewhat narrower than the packaging film as illustrated in FIG. 2.

Preferred embodiments of the invention will now be described in further detail with respect to particular arrangements of web tensioners with which banner stock can be fed into joinable proximity with the web in the illustrated embodiment of the invention. It has been found that by using this arrangement of web tensioning devices, the continuous banner can be processed through the apparatus with little or no interference with the advancement of the packaging film. Other suitable arrangements will be apparent to those skilled in this field, however.

Figure 3:
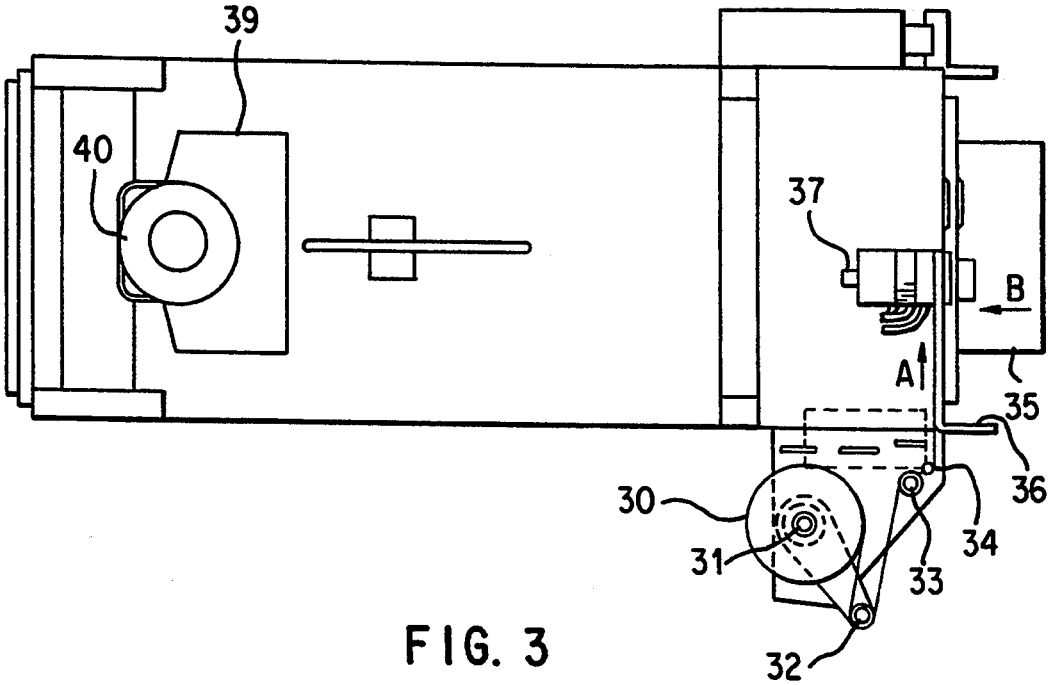
FIG. 3 is a top view of one embodiment of the invention.

As illustrated in FIG. 3, banner roll stock 30 is fed (arrow A) into joinable proximity with web material 35 at a 90° angle to the direction (arrow B) in which web 35 is fed into the apparatus. A 45° turn bar 36 is employed to redirect the path of the banner stock to coincide with the path of the web of packaging material. At the point banner stock 30 is fed into joinable proximity with web material 35, the two webs are parallel and traveling in the same direction towards an adhering means 37. By "joinable proximity," it is meant that the banner is in contact with the web material or slightly separated, for example by 6 mm.

Figure 4:
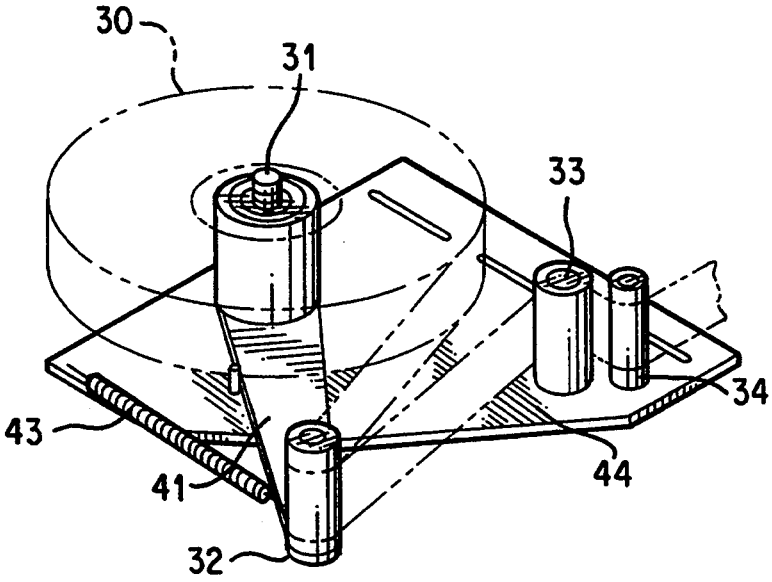
FIG. 4 is a perspective view of a means for feeding banner stock to one embodiment of the invention.

As illustrated in FIG. 4, the roll of banner stock 30 is placed on an unwind reel 31 which affects a certain tension as stock is unwound. In this particular embodiment, the stock is fed around dancer roller 32 and idle rollers 33 and 34. Dancer roller 32 is positioned on an arm 41 which is attached to the banner play-out apparatus at a point along the axis of the banner roll 30. Arm 41 is free to swing about the axis of the roll 30 so that variations in play-out tension can be absorbed. The arm's swinging action is partially dampened by a spring 43 and partially by the tension of the banner stock as it is pulled through the apparatus. The idle rollers 33 and 34 are attached to the same support plate 44 of the play-out apparatus on which the unwind reel 31 is mounted.

Figure 5:
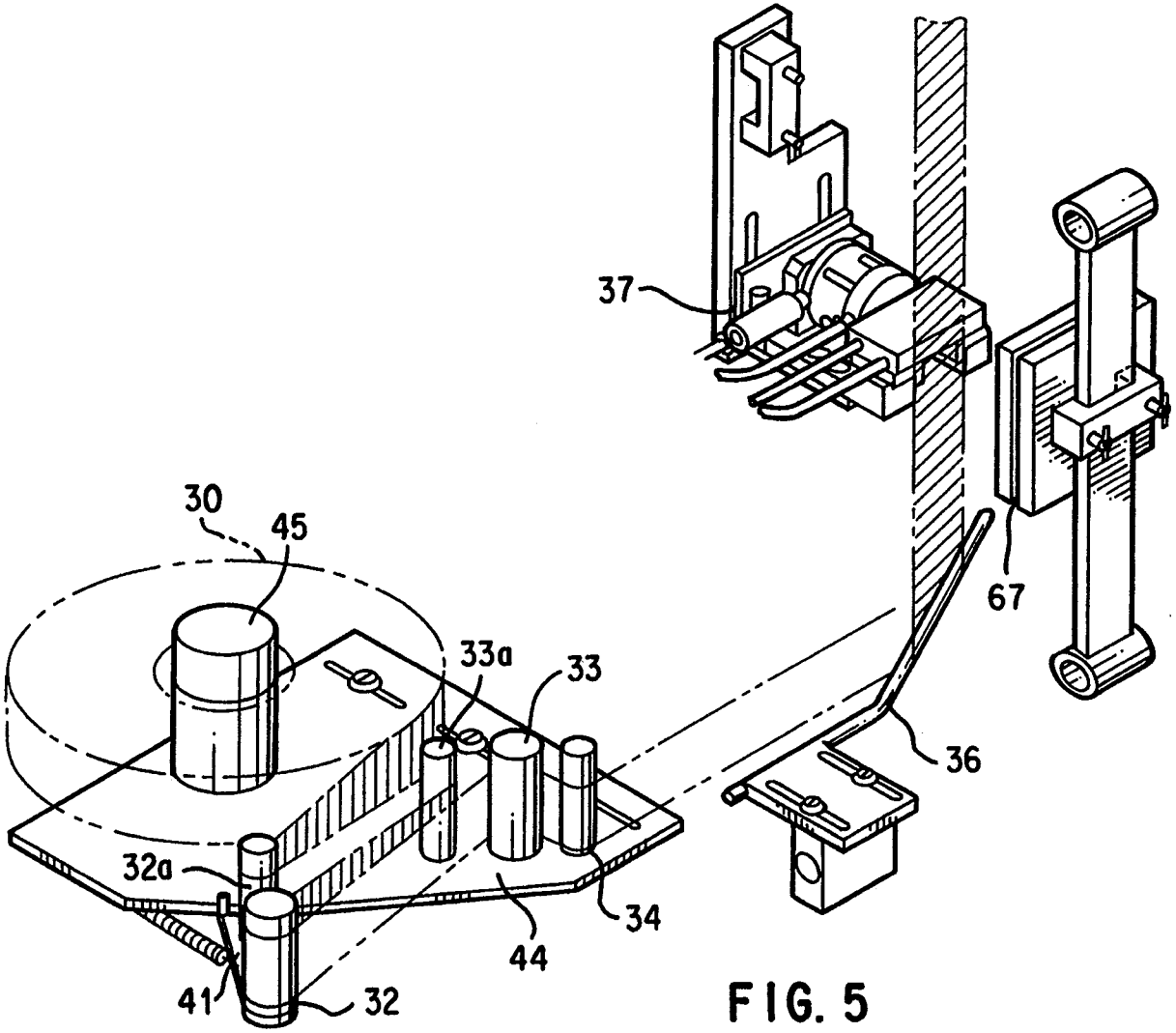
FIG. 5 is a perspective view of the means for feeding banner stock to one embodiment of the invention, as well as a perspective view of a means for adhering the banner stock to web material as it is being processed in that embodiment.
Figure 6:
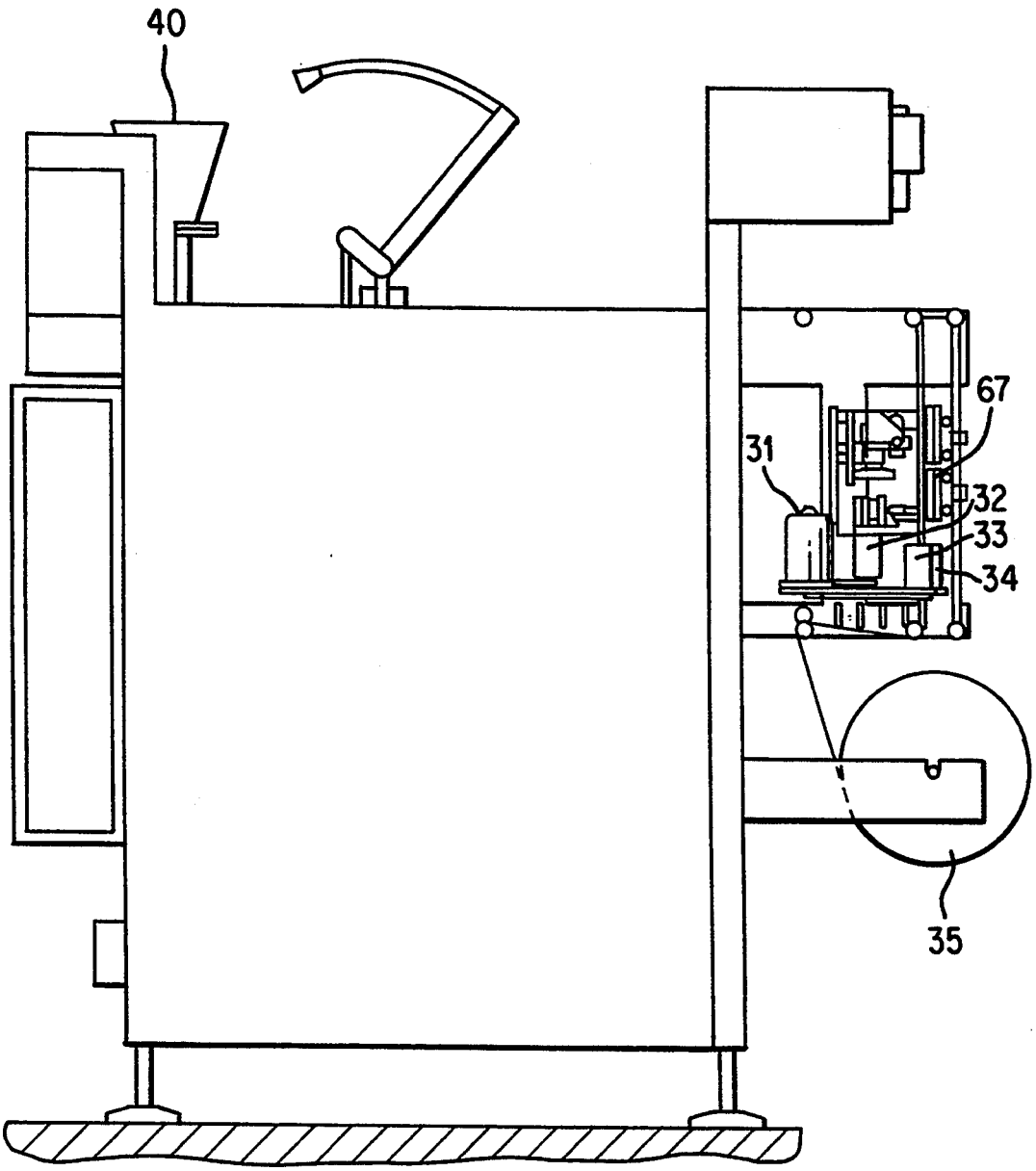
FIG. 6 is another elevational view, partly schematic, but a more detailed view than FIG. 1, of one embodiment of the invention.
Figure 7:
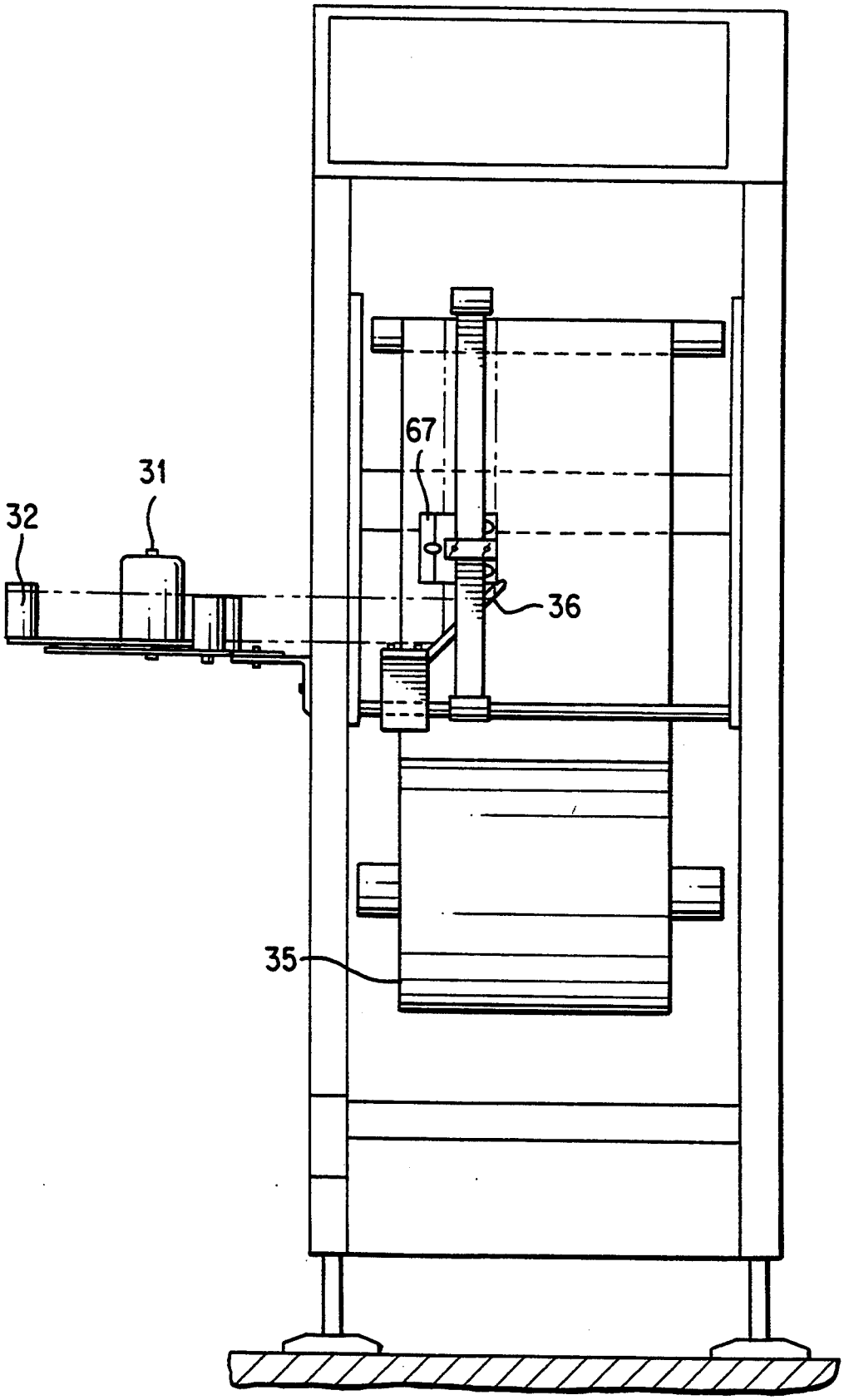
FIG. 7 is an elevational view illustrating a means for feeding banner stock to one embodiment of the invention. This view is 90° from the viewing angle illustrated in FIG. 6.

FIG. 5 illustrates another apparatus for controlling the play-out of the banner stock. A spring-activated tension adjustment means 45 is installed within the hub on which the roll is mounted and permits the tension upon roll 30 to be varied as the banner is dispensed. The banner stock is fed past a first dancer roller **32*a*, idle roller 33*a*, dancer roller 32 (which is mounted on the same arm 41 on which roller 32*a* is mounted) and then idle rollers 33 and 34**.

FIG. 5 also illustrates the 45° turn bar 36 and heat seal unit 37. After the banner web has been redirected by turn bar 36 into joinable proximity of the packaging material web (not shown in FIG. 5), heat seal unit 37 adheres the two materials together.

The heat seal unit 37 illustrated in FIG. 5 is a conventional heat seal bar which is actuated by an air cylinder under the control of an automated system controller. The heat seal bar in conjunction with a back up pad 67 tacks the web to the banner. In this embodiment, the two webs are advanced through the heat seal unit 37, 67 at increments equal to the length of the package to be prepared, and the seal bar is actuated once every advance. The two webs preferably have been indexed in proper registration through the form-fill-seal apparatus so that the tack line is placed roughly equidistant from the top and bottom seals of the finished package.

Adhering means other than heat seal bars may also be employed. For example, a conventional continuous hot roller nip may be used to continuously seal the banner to the web material, or hot air knives may be employed.

The united banner stock and web of packaging material are trained towards the collar 39 and forming and filling tube 40. The united web is pulled over the surface of collar 39 and around tube 40, oriented such that the banner is disposed along the exterior surface of the preform. The longitudinal edges of web material 35 are sealed in a typical lap or fin seal arrangement, and the united web is further advanced down tube 40 as a tubular package preform with the banner affixed to the outer surface of the preform.

Advantageously, the apparatus for grasping and advancing the preform can be any typically used in this field; the invention is not limited to the use of clamping jaws as was the prior art. A preferred embodiment of the invention includes a conventional pull belt apparatus (not shown). Generally, such apparatus includes a pair of endless belts, with each belt arranged around a pair of pulleys. Each belt and set of pulleys are placed opposite to another belt and set of pulleys on one side of the forming and filling tube. The belts are typically engaged with the preform by a vacuum system which acts to draw the preform into contact with the belt. The belts are operated intermittently so that the preform is advanced (indexed) along the tube at lengths which coincide with the desired length of the finished package.

In the sealing operation of the apparatus, the sealing unit seals the lower end of the preform to provide essentially a closed-bottomed tube. The closed tube is then filled with the desired product via forming and filling tube 40. The preform is further indexed downward, and the sealing means is activated once again to seal the upper end of the tube and sever the finished package from the continuous web above. The sealing unit schematically illustrated in FIG. 1 represents a conventional clamp sealer which is equipped with a severing knife. However, any conventional sealing unit may be employed.

As previously mentioned, the apparatus of this invention also employs conventional systems under computer control for synchronization and orchestration of the various operations. The apparatus may also employ conventional devices and methods to reduce film waste and to increase sealing efficiency. For instance, waste can be lowered by the employment of systems which shut down the apparatus when the banner supply is either low or depleted. Sealing efficiency and consistency can be regulated by the use of a digital temperature controller for the seal units.

The invention has been found to reduce banner loss significantly, typically keeping loss to only about 0.25%. In contrast, an apparatus in which the banner stock was introduced to the web of package-forming material after it was prepared into a preform experienced up to 30% loss of banner material.

Many modifications, variations and changes in detail may be made to the described embodiments, and it is intended that all matter in the foregoing description and shown in the accompanying drawings be interpreted as illustrative and not in a limiting sense.

What is claimed is:

1. A method for making a filled, sealed flexible package having a promotional banner releasably secured thereto to allow removal of the banner from the filled and sealed package without affecting the sealed condition of the package, the method comprising the steps of:

feeding a continuous web of flexible packaging stock and a continuous web of pre-printed banner stock within joinable proximity of each other;

releasably adhering the continuous web of banner stock to the continuous web of packaging stock at selected areas thereof to facilitate feeding of the web of banner stock and the web of packaging stock as a continuous united web to package-forming means; and feeding the united web to the package-forming means to produce a filled, sealed flexible package having an exterior surface which has a banner attached thereto so as to be removable without damaging the sealed condition of the package.

2. A method according to claim 1 wherein the step of feeding the united web to package-forming means comprises passing the united web around a forming collar of a vertical form-fill tube.

3. A method according to claim 1 wherein the banner stock and packaging stock are maintained in a registered relationship during the adhering step.

4. An apparatus for producing a filled, sealed flexible package having a promotional banner releasably attached thereto, comprising:

feeding means for feeding a continuous web of flexible packaging material within joinable proximity of a continuous web of banner stock;

adhering means for adhering at least a selected area of the continuous web of banner stock to the continuous web of packaging material to form a continuous united web which can be fed as a unitary structure to packaging means, with the web of banner stock adhering to the web of packaging material during processing by said packaging means but being removable therefrom without damaging the packaging material; and packaging means for forming the united web into a filled sealed package with said web of banner stock releasably adhered to the package so as to be removable therefrom without damaging the sealed condition of the package.

5. An apparatus according to claim 4 including means for dispensing the web of banner stock and means for maintaining the dispensed banner stock under tension.

6. An apparatus according to claim 4 wherein the adhering means comprises a sealing unit.

7. An apparatus according to claim 4 further comprising registration means for maintaining the banner stock and the flexible packaging material in a registered orientation.

8. An apparatus according to claim 4 wherein the packaging means includes a vertical form, fill and seal apparatus.

* * * * *